US005402985A

United States Patent [19]

Owens et al.

[11] Patent Number: 5,402,985

[45] Date of Patent: Apr. 4, 1995

[54] ROPE WINCHES

[75] Inventors: Peter L. Owens, Takapuna; David J. Ironside; Graham J. Marsh, both of Auckland, all of New Zealand

[73] Assignee: Maxwell Winches Limited, New Zealand

[21] Appl. No.: 110,395

[22] Filed: Aug. 23, 1993

[51] Int. Cl.[6] ..... B66D 1/00

[52] U.S. Cl. ..... 254/333; 254/372

[58] Field of Search ..... 254/333, 372, 374, 382; 226/168

[56] References Cited

U.S. PATENT DOCUMENTS

| | | | |
|---|---|---|---|
| Re. 30,591 | 4/1981 | Newell | 254/333 |
| 2,802,636 | 8/1957 | Sandford | 254/333 |
| 3,055,638 | 9/1962 | Good . | |
| 3,078,074 | 2/1963 | Benedict . | |
| 3,231,240 | 1/1966 | Naito | 254/333 |
| 3,847,378 | 11/1974 | Roemer, Jr. . | |
| 5,082,248 | 1/1992 | Harig | 254/333 |
| 5,314,166 | 5/1994 | Muir | 254/372 |

FOREIGN PATENT DOCUMENTS 2233623 1/1991 United Kingdom .

*Primary Examiner*—John M. Jillions

*Attorney, Agent, or Firm*—Poms, Smith, Lande & Rose

[57] ABSTRACT

A single sheave 4 rope winch 1 particularly suitable for use with an anchor warp 2. The sheave 4 is fixed on a shaft 5 rotatably mounted in a base 3 adapted for mounting on a deck of a vessel. An electric motor 6 operates through a gear-drive 7 to rotate the sheave 4 about a vertical axis. Warp feed-in and feed-out means 8 and 9 direct a warp 2 to and from the sheave 4. Warp guide means 19 control a warp 2 during its tracking about with or through the sheave 4, the guide means 19 including a fixed and shorter section 19*a* and a longer articulated arm 27 section 19*b*. The arm 27 is arcuately shaped to extend about a sector of the sheave 4 and is biased by spring 26 radially inward such that an inner face 24 thereof impinges onto a warp 4 tracking in that sector of the sheave 4. In a preferred embodiment the inner impinging face 24 of the arm 27 incorporates a compound curvature, the radius of curvature increasing toward a free end of the arm 27.

6 Claims, 2 Drawing Sheets

20
22

12
11
4
4B
17
26
8
1
23
18
27
15
9
5
24
3
19B
17
4A
25
21
1A
16
28
19
4A
27
18
3
1A
19B
7
6

FIG. 2
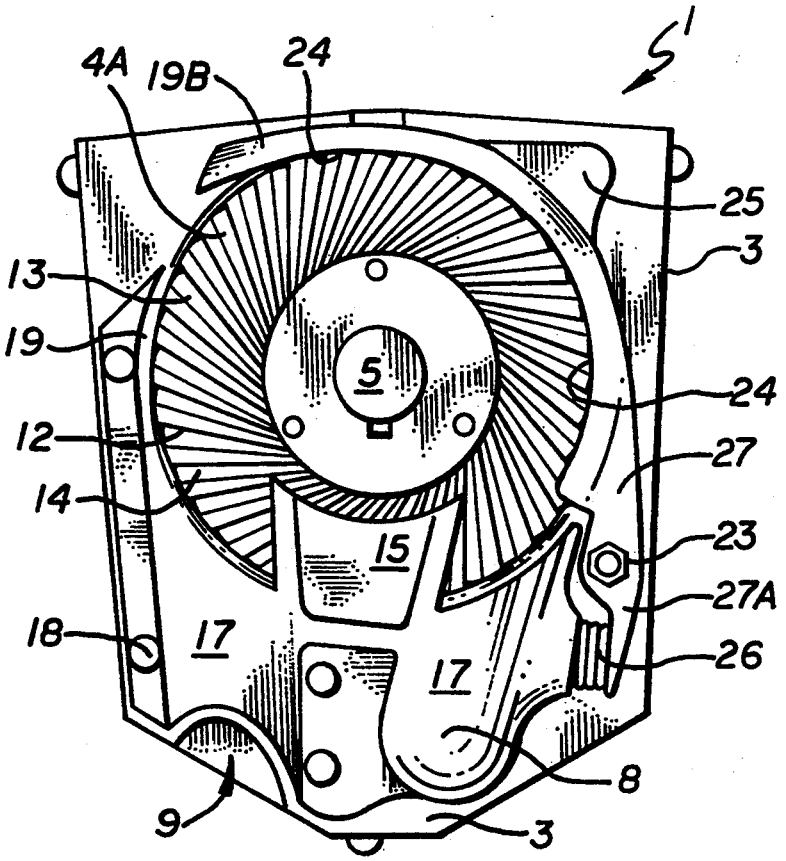
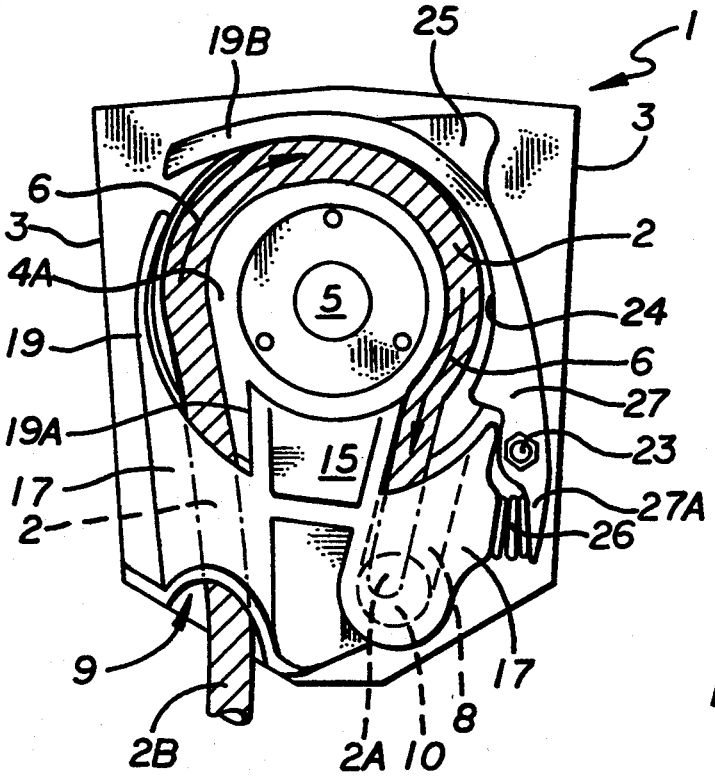
FIG. 3

ROPE WINCHES

BACKGROUND OF THE INVENTION

1. Field of the Invention

This invention relates to rope winches and more particularly relates to a rope winch suitable for raising a rope anchor warp of typically a pleasure vessel. Such a winch includes a sheave which takes one turn, and more precisely a part turn, only of a rope thereabout as distinct to a drum winch wherein several turns are normally required or recommended to achieve grip.

2. State of the Art

Single sheave winches of various designs are known, these including an earlier design of ours and which is described in U.K. Patent 2233623, and the winches described in U.S. Pat. Nos. 3,078,074 ; 3,055,638 and 3,847,378. The winches disclosed in each of these patents includes some form of impingement means to control a rope in its travel about an associated sheave. It is in this facet that the present invention differs from any of the prior art in providing an impingement means assembled in a structural relationship with other rope guide means which is not disclosed in or comprehended by the prior art.

A fundamental problem of such single sheave winches is the achieving of appropriate frictional grip on, and thus control of, a rope. Too little grip can result in slipage and too much grip can result in wedging of the rope in the sheave and consequentially the need for stripping a rope therefrom. Achieving the desired grip in an anchor winch is a particular problem as the loads involved with the lowering and raising operational modes thereof represent essentially opposite loading requirements. That is, normally there is no load in a lowering mode and full load in a raising mode. However, such nominal operational modes or conditions do not convey the complete case as the operating dynamics or requirements can at any moment change from one mode or condition to the other.

As a first example, in a nominal raising mode, at the commencement of raising an anchor may snag and the loading on the winch greatly increase. Particularly if the anchor does not promptly come free too much grip can cause overloading of the winches prime mover and/or excessive wearing on the anchor warp. With an anchor becoming free from such circumstances and, even with an essentially clear extrication, at least for an instance, no load conditions can prevail resulting in slack developing in the warp. This can cause jamming of the warp in the winch.

As a second example, in a nominal lowering mode, while there can be said to be no load there remains a need to control the warp. Nominal no load conditions arise as little load is involved in drawing a tail of a warp into the sheave however even this load can tend to be overridden by the momentum developed by a descending anchor. This can cause run through or free running of a warp through a winch. However, if there is too little grip excessive run through or free running may result which can cause jamming; typically a tail of a warp feeding into a winch can become entangled and jam-up. Further, the momentum of a lowering anchor can change abruptly with the rise and fall of an associated vessel in say the swell of the surrounding waters. For example, with the bow of a vessel coming down off a swell the momentum generated in an associated anchor can cause the warp supporting the anchor to be drawn excessively through the winch. With such excessive run through it may be necessary to reverse the operating mode of a winch to achieve braking on the warp.

Additionally it is commercially preferable that a range of different diameter warps be operable with any particular sized winch. It is manifest that reasonable correlation between the diameter of a warp and the spacing of the jaws of a sheave is fundamental to achieving grip. Achieving the aforesaid criteria for a range of winches thus also represents a problem.

An intention of this invention is to provide a one turn or single sheave winch particularly suitable for operation with a rope anchor warp which it is envisaged will alleviate the aforesaid problems or at least provide a useful choice.

SUMMARY OF THE INVENTION:

According to a first aspect of this invention there is provided a rope winch comprising a sheave mounted to a body and adapted to be rotated by a prime mover, rope feed-in and rope feed-out means leading to and from the sheave and attached to the body to be spaced radially and adjacently apart about the sheave, a leader to direct a rope between the sheave and the feed-in means, and rope guide means extending in adjacent spaced relationship substantially fully about a longer of the sectors of the sheave between the rope feed-in and rope feed-out means, the rope guide means including a shorter fixed section adjacent to the rope feed-out means and a longer biased arcuate arm section articulately mounted adjacent to and down-stream of the rope feed-in means with the biasing means tending to force the arm radially inward of the sheave.

According to a second aspect of this invention there is provided a rope winch as described in the preceding paragraph wherein the arm extends substantially 180 degrees about the sheave.

According to a third aspect of this invention there is provided a rope winch as described in either of the two preceding paragraphs wherein the arcuate arm is of a compound curvature with the radius of curvature increasing toward the free end of the arm.

BRIEF DESCRIPTION OF THE DRAWINGS.

In further describing the invention reference is made to the accompanying drawings of a preferred embodiment and wherein:

FIGS. 2 and 3 are plan views in the direction of arrow "A" on FIG. 1, the elements depicted in exploded relationship and the prime mover and geardrive of FIG. 1 not being depicted in these figures. Further, less detail is included on FIG. 3 which depicts the winch with a rope extending therethrough.

Figure 1:
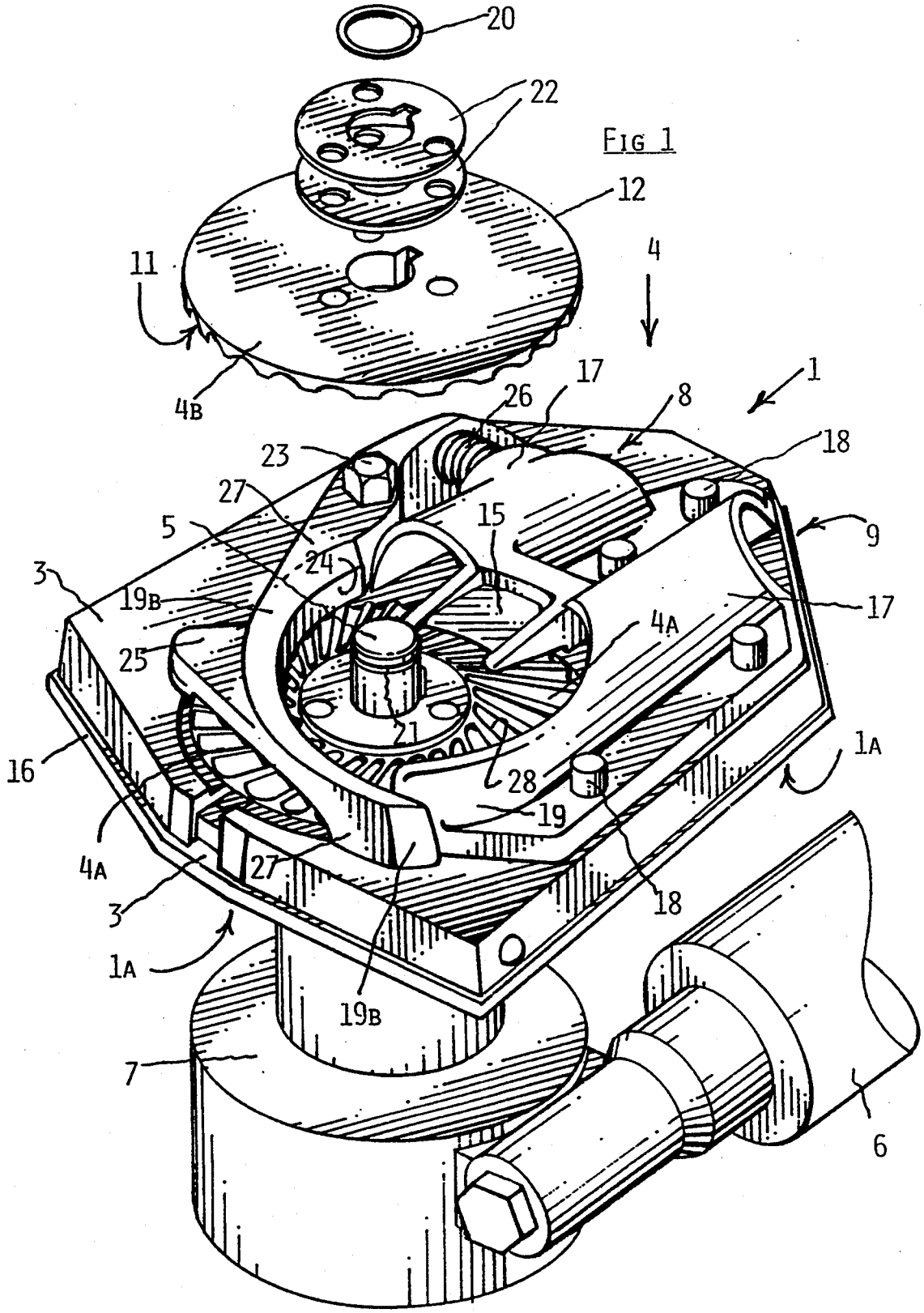
FIG. 1 is a perspective view of the winch with, for the sake of clarity, a cover removed and with some elements depicted in exploded relationship to others thereof. The figure includes a prime mover and connecting gear-drive for the winch both depicted in outline.

DETAILED DESCRIPTION OF A PREFERRED EMBODIMENT OF THE INVENTION.

A rope winch 1 suitable for operation with a rope anchor warp 2 of a pleasure vessel (not depicted) comprises a base 3 adapted for appropriate mounting onto a deck of such a vessel. In general terms, to describe a typical mounting, winch 1 includes a sheave 4 mounted on as to be rotatable with a vertically disposed shaft 5 rotatably mounted in base 3 and driven by a prime mover 6. Preferably prime mover 6 is a suitable electric motor which, as depicted in FIG. 1 is coupled to and operates through a gear-drive 7. The underside la of the base 3 is adapted to seat on and be fastened (such as by downwardly directed studs, not depicted for the sake of clarity) to a top side of a deck. A gasket 16 is preferably provided to seat between the base 3 and a deck with the gear-drive 7 and motor 6 depending down from the winch 1 on the underside of the deck. Suitable controls (not depicted) such as appropriate switching for prime mover 6 enable the shaft 5 and thus the sheave 4 to be rotated either clockwise or counter-clockwise. Referring to FIG. 3, the clock-wise directed arrows 6 depict a raising mode of the winch. The rope warp 2 enters and exists sheave 4 via rope feed-in means 8 and rope feed-out means 9 respectively and as more particularly described below. The rope feed-in 8 preferably directs a tail 2*a* of a warp 2 through an arcuate path to a port 10 in the underside 1*a* of the base 3, with port 10 aligning with a port formed in the deck to feed the warp tail 2*a* into, for example, a rope locker beneath the deck.

In conventional manner sheave 4 has an inwardly tapered circumferential groove formed by two opposing circular jaws 4*a* and 4*b*. Jaws 4*a* and 4*b* have tapered surfaces 28 and 11 which tapered radially toward each other from the outer periphery 12 of sheave 4. Tapered surfaces 28 and 11 preferably incorporate radially disposed grooves and ribs 13 and 14 alternatively spaced thereabout to tend to engage the helixes of a rope warp 2 to provide additional grip thereon. Preferably the grooves and ribs 13 and 14 are disposed at an angle to a true radially disposition. More particularly, referring in particular to FIG. 2, the ends of the grooves and ribs 13 and 14 at the outer periphery 12 of the sheave 4 leading (in a raising mode rotation of sheave 4) the inner ends of the grooves and ribs 13 and 14.

Preferably the jaws 4*a* and 4*b* are formed as separate elements and are mounted together on shaft 5 by a retaining clip washer 20 engaging in groove 21 on shaft 5. With such mounting preferably spacers 22 are provided at least one of which can, if desired, be mounted on shaft 5 between jaws 4*a* and 4*b* to increase the spacing therebetween thereby adapting the sheave 4 for a range of warps 2 of a greater diameter.

As the winch is operated both clockwise and counter-clockwise, herein for simplicity the terms "feed-in" and "feed-out" are used in relation to the tail section 2*a* of a warp 2 and a loaded or anchor coupled section 2*b* of a warp 2 respectively. Preferably the rope feed-in means 8 and rope feed-out means 9 are formed by a unitary casting 17 incorporating two tunnel formations forming the rope feed-in and feed-out means 8 and 9 which is mounted by studs 18 on the upper side of base 3 to be co-planar with sheave 4.

More particularly the rope feed-in means 8 and rope feedout means 9 are disposed in adjacent radially spaced apart relationship about the periphery of sheave 4 such that a "track" of a warp 2 within sheave 4 extends about approximately three-quarters of the periphery thereof. Considered schematically and referring in particular to FIGS. 2 and 3, feed-in means 8 and feed-out means 9 can be considered as disposed at or about a five o'clock and eight o'clock position respectively with respect of sheave 4. This divides the sheave 4 into two sectors being a shorter sector extending from the five o'clock position to the eight o'clock position and a longer sector extending from the eight o'clock position to the five o'clock position.

Feed-in means 8 directs the tail 2*a* of a warp 2 to and from sheave 4 through an arcuate path to port 10. Feed-out means 9 directs an anchor section 2*b* of a warp 2 substantially tangentially to and from a sheave 4. Thus, the "track" of warp 2 within sheave 4 takes up a longer of the two sectors, and as described in more detail hereinafter, it is in the longer sector that warp guide means 19 operates. Casting 17 preferably includes a warp 2 leader 15 between feed-in means 8 and feed-out means 9. Leader 15 projects into the groove of sheave 4 and, as illustrated in FIG. 3, operates primarily to strip and lead a warp 2 from sheave 4 to feed-in means 8 during a raising or loaded operational mode of the winch 1. With reverse operation, that is, in a lowering mode, leader 15 at that side thereof adjacent feed-in means 8 assists in directing a warp 2 into sheave 4. The side of leader 15 adjacent feed-out means 9 acts in a similar manner to that described above but in normal circumstances the need for stripping at this point is unnecessary or minimal.

Rope guide means 19 extends substantially fully about the warp 2 "track" sector of the sheave 4 in adjacent spaced relationship therewith. Guide means 19 acts to keep a warp 2 "tracking" within the sheave 4 during both a hauling in, that is a raising mode, and a paying-out or lowering mode, particularly the latter, either as a consequence of appropriate rotation of the sheave 4 and/or "run through" caused by a free-falling anchor.

Guide means 19 form a peripherally extending barrier about sheave 4 entrapping a warp 2 within the sheave 4 and, as more particularly described hereinafter, an articulated section 19*b* of the guide means 19 also tends to impinge a warp 2 radially inward to facilitate grip by sheave 4 on a warp 2.

A fixed and shorter section 19*a* of the guide means 19 extends from adjacent the feed-out means 9 peripherally for about approximately a quarter sector of sheave 4. Preferably the fixed guide means 19a is formed by a projecting arm incorporated on casting 17 to essentially enclose the associated sector of the groove of the sheave 4.

Articulated section 19*b* of the guide means 19 comprises an articulately mounted arm 27. Arm 27 is of an arcuate formation and is disposed to extend about substantially the remainder (which equates with a sector of some 180 degrees of the periphery of the sheave 4) of the "track" sector of sheave 4. As with casting 17, arm 27 is mounted on the upper face of base 3 to be co-planar with sheave 4. A point of articulation 23 for arm 27 on base 3 is disposed adjacent to and radially outward of the feed-in means 8. Referring in particular to FIG. 3, preferably arm 27 has about an inner face 24 thereof a compound curvature with the radius of curvature increasing toward the free end thereof. Empirically it has been shown that providing a compound curvature for face 24 of approximately a 52mm radius blending to approximately a 68mm radius is suitable for use with sheaves 4 having a range of root diameters of about 60mm to 120mm and intended for use with warps 2 of diameters from 12mm to 16mm.

Preferably a radially outward projection 25 is formed on the arm 27 about medially of the length thereof. Projection 25 includes a downwardly extending section which rests and slides on the upper face of base 3 as the arm 27 articulates. Projection 25 thus provides a cantilevered support for and spaces the arm 27 adjacently clear of the base 3 enabling arm 27 to enter the groove of the sheave 4.

Biasing means are provided to tend to direct the arm 27 radially inward of sheave 4. To that end a spring 26 is fitted between casting 17 and a tail section 27*a* of the arm 27. Thus the tail section 27*a* is biased outwardly and consequentially the arcuate section of the arm 27 is biased essentially radially inward as will impinge onto a warp 2 as it passes through and around with sheave 4.

We claim:

1. A rode winch comprising a base, a sheave having a periphery and a longer sector and a shorter sector and mounted to the base, a prime mover in operative communication with the sheave, rope feed-in and rope feed-out means attached to the base leading to and from the Sheave and disposed adjacent to each other so as to be positioned radially about the sheave periphery, a leader disposed between the rope feed-in means and feed-out means rope guide means having a shorter fixed section and a longer section and extending substantially about the sheave longer sector in adjacent spaced relationship between the rope feed-in and feed-out means, the shorter fixed section is disposed adjacent to the rope feed-out means. the longer section is an arcuate arm having a free end and a compound curvature, said arm being pivotally mounted on the base adjacent to and down-stream of the rope feed-in means and extending substantially 180 degrees about the sheave with the compound curvature increasing toward the free end of the arm, and means fitted on the arm for biasing the arcuate arm radially inward of the sheave.

2. A rope winch as claimed in claim 1 wherein the sheave is formed from two separate opposing circular jaw elements mounted together on a shaft, the shaft being rotatably coupled to a gear-drive, said gear-drive being coupled to the prime mover, and further comprising a spacer mounted between the jaws.

3. A winch as claimed in claim 2 wherein the leader is disposed between the feed-in and feed-out means and projects into the groove of the sheave and acts to lead and strip a warp therefrom to the feed-in means and feed-out means.

4. A winch as claimed in 3 wherein the arm extends from a point of articulation thereof adjacent to the feed-in means 180 degrees about the periphery of the sheave with the free end thereof being disposed adjacent an end of the fixed section of the guide means.

5. A winch as claimed in claim 4 wherein the shaft is rotatably mounted in the base with the arm being articulately mounted to the base, and the feed-in means, the feedout means and the leader being fixed to an upper face of the base to be disposed substantially co-planar with one another and the groove of the sheave.

6. A winch as claimed in claim 5 wherein the arm includes a radially outward projection medially along the length thereof and which includes a downwardly extending section to rest and slide on the upper face of the base to provide a cantilevered support for the arm in entering the groove of the sheave.

* * * * *